United States Patent [19]

Molins et al.

[11] 4,111,740

[45] Sep. 5, 1978

[54] APPARATUS FOR JOINING AXIALLY ABUTTING RODS OF THE CIGARETTE INDUSTRY

[75] Inventors: Desmond Walter Molins, London; Tom Rowlands, Keston, both of England

[73] Assignee: Molins Limited, England

[21] Appl. No.: 772,678

[22] Filed: Feb. 28, 1977

[30] Foreign Application Priority Data

Feb. 28, 1976 [GB] United Kingdom ..... 7927/76

[51] Int. Cl.[2] ..... B65H 69/02

[52] U.S. Cl. ..... 156/498; 118/218; 118/230; 118/233; 118/246; 118/261; 156/499; 156/539; 156/304

[58] Field of Search ..... 118/218, 219, 230, 232, 118/233, 224, 246, 261; 156/158, 296, 304, 291, 449, 450, 578, 538, 567, 499, 539, 498; 427/277, 278, 286; 131/37

[56] References Cited

U.S. PATENT DOCUMENTS

| | | | |
|---|---|---|---|
| 2,868,403 | 1/1959 | Mattingly et al. | 118/219 |
| 3,420,243 | 1/1969 | McArthur | 156/578 |
| 3,563,781 | 2/1971 | Johnson | 118/219 |
| 3,565,034 | 2/1971 | Birchall et al. | 118/219 |
| 3,598,675 | 8/1971 | Bofinger et al. | 156/450 |
| 3,834,963 | 9/1974 | Hoffman | 156/450 |
| 3,930,930 | 1/1976 | De Keyser et al. | 156/578 |
| 3,956,057 | 5/1976 | Jung | 156/578 |

*Primary Examiner*—Jerome W. Massie
*Attorney, Agent, or Firm*—Craig & Antonelli

[57] ABSTRACT

Apparatus for joining at least two axially abutting rods of the cigarette industry comprises means for delivering the rods to a rolling drum, a rolling device mounted adjacent to the drum to roll the rods with respect to the drum, and means for applying a hot-melt adhesive to the rods to produce a bonding film which overlaps the adjacent ends of the rods and extends at least around a major part of the circumference of the rods.

The adhesive may be applied by a nozzle directly to the rods, or may be applied initially to the drum as a film which is then picked up by the rods.

15 Claims, 10 Drawing Figures

FIG. 9.
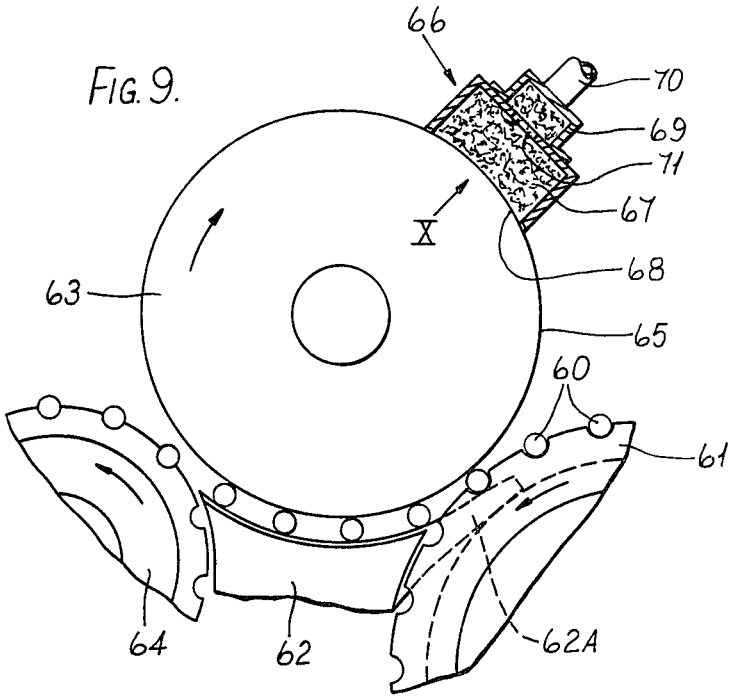
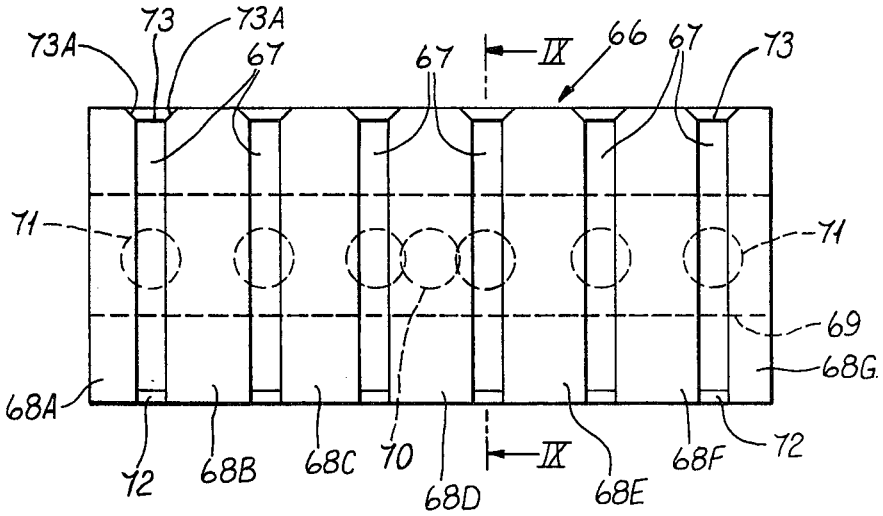
FIG. 10

APPARATUS FOR JOINING AXIALLY ABUTTING RODS OF THE CIGARETTE INDUSTRY

This invention is concerned with joining axially abutting rods of the cigarette industry. It is particularly concerned with joining together two or more axially abutting filter rods of different materials.

Our patent application U.K. No. 13823/75 (and corresponding German Offenlegungschrift 2,614,651) describes the following method of joining together axially abutting filter sections to form composite filter rods. Groups of filter sections are formed, each group consisting of alternate filter sections of different materials. Each group is then subjected to a rolling operation during which narrow strips of paper are wrapped around adjacent abutting portions of the filter sections, the strips previously having adhesive applied to them so that they adhere to the filter sections. Each group thus forms a composite filter rod which can be fed into a filter attachment machine for use in a conventional manner.

According to the present invention, apparatus for joining at least two axially abutting rods of the cigarette industry comprises means for delivering the rods to a rolling drum, a rolling device mounted adjacent to the drum to roll the rods with respect to the drum, and means for applying a hot-melt adhesive to the rods to produce a bonding film which overlaps the adjacent ends of the rods and extends at least around a major part of the circumference of the rods.

The term "hot-melt adhesive" means in this context a material which is applied in liquid form at above-atmospheric temperature and then sets upon cooling. It applies particularly to a thermo-plastic material. However, a suitable adhesive for use in the present invention could in principle be a thermo-setting material, that is to say a material which sets irreversibly on cooling down.

The adhesive is preferably slightly flexible after it has set. Alternatively, it is possible to use a wax such as sealing wax, but the brittleness of that material would produce composite rods which require fairly careful handling.

This invention results in a considerable simplification and a reduction in the cost of the apparatus for joining rods. It is particularly applicable to the construction of composite filter rods, but it could also be applied in the joining of filters to cigarettes.

Examples of apparatus according to this invention are shown diagrammatically in the accompanying drawings. In these drawings;

FIG. 9 is a partly sectioned elevation of another apparatus; and

FIG. 10 is a view of the adhesive applicator, to an enlarged scale, of the apparatus shown in FIG. 9, the view being in the direction of the arrow X in FIG. 9.

Figure 1:
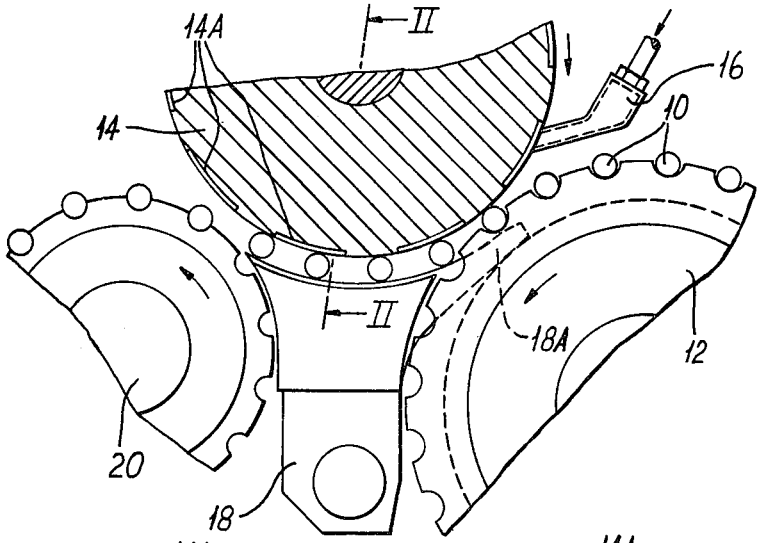
FIG. 1 is a partly sectioned elevation of part of one apparatus.
Figure 3:
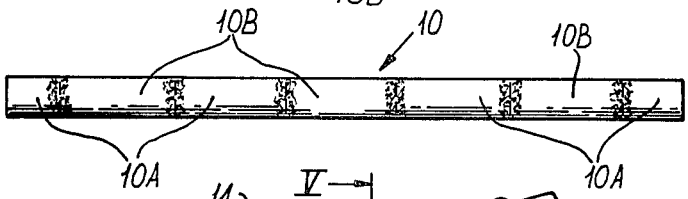
FIG. 3 is a side elevation showing a completed composite filter rod.

FIG. 1 shows groups of axially abutting filter sections 10 being carried by a fluted drum 12 towards a rolling drum 14. As shown in FIG. 3, each group comprises filter sections 10A of one material and interposed filter sections 10B of another material. For example, the sections 10A may be paper-filled, and the sections 10B may have a cellulose acetate fibre filling.

Figure 2:
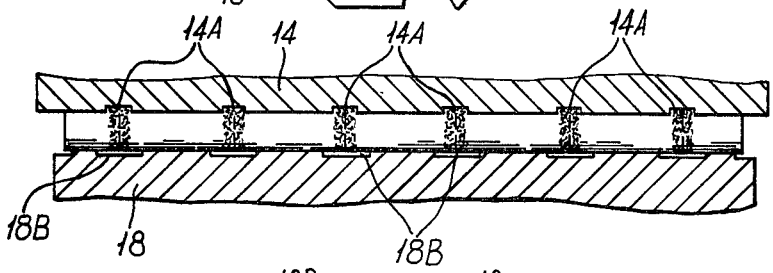
FIG. 2 is a section on the line II—II in FIG. 1.

The rolling drum 14 is formed with a number of axially spaced sets of shallow grooves **14*a*, each set being aligned with one of the joints between adjacent filter sections as shown in FIG. 2. Each set comprises a number of circumferentially spaced grooves, the arrangement being such that the leading end of each groove meets a group of filters, as shown in FIG. 1. The grooves are shown in FIGS. 1 and 2** with an exaggerated depth for the sake of clarity.

Each groove **14*a* receives a film of hot-melt adhesive which is supplied through a nozzle 16**. The outlet of the nozzle is closed by the drum, except when a groove in the drum is aligned with the nozzle. A pump (not shown) delivers the adhesive at above-atmospheric temperature and at a predetermined pressure.

At the tangent point between the two drums 12 and 14 a number of axially spaced parallel fingers 18A on a rolling plate 18 strip the filter sections out of the flutes of the drum 12 and press the filter sections against the rolling drum 14. As a result, the filter sections are rolled relative to the rolling drum 14 and relative to the rolling plate 18, starting with the fingers 18A. Thus the films of adhesive from the grooves 14A are applied around the abutting portions of the filter sections. The rolling plate may have grooves 18B (see FIG. 2) to provide clearance for the adhesive, i.e. prevent contact of the rolling plate with the adhesive; alternatively such grooves may be omitted and the rolling plate may help to spread the adhesive and to cool it. The final film of adhesive around each pair of abutting filler sections may, for example, be about 0.050 to 0.075 mm in thickness. If the rolling plate does contact the adhesive, it may have cooling passages whereby its temperature can be maintained at the appropriate level to assist in setting the adhesive. The drum 14 may be heated to maintain a temperature sufficient to keep the adhesive in a liquid or semi-liquid state until it has been applied to the filter sections.

The completed composite filters are received by a second fluted drum 20.

The drum 14 rotates with a peripheral speed substantially twice that of the drums 12 and 20 so as to keep the speed of bodily movement of the filters substantially constant.

The adhesive need not necessarily be applied as a rectangular film patches of uniform thickness. For example, it could be coloured and could be applied as a print in which clear areas represent a legend (e.g. the brand name of the article) or an attractive pattern. This applies particularly if the invention is used in the attachment of filters to cigarettes. The clear areas (i.e. where there is substantially no adhesive) should be remote from the actual region of the joint between the abutting rods.

Figure 4:
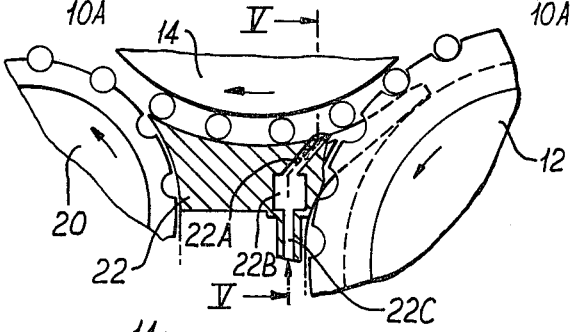
FIG. 4 is a partly sectioned elevation of another apparatus.
Figure 5:
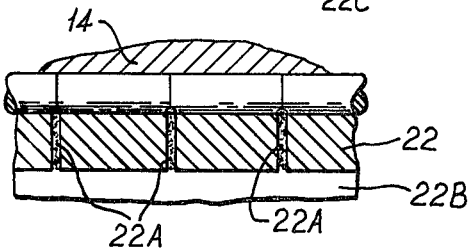
FIG. 5 is a section along the line V—V in FIG. 4.

FIG. 4 shows a different form of apparatus. This apparatus is similar to that shown in FIG. 1 in that there is a rolling drum 14, a fluted delivery drum 12 and a fluted discharge drum 20. However, in this example the adhesive is supplied through a rolling plate 22. For this purpose the rolling plate 22 has a number of slit-like passages 22A which serve as nozzles; the adhesive enters the passages 22A from a common manifold 22B extending along the rolling plate. A constant-volume pump, for example a peristatic pump, supplies the adhesive in liquid form to the manifold 22B via a pipe 22C at a flow rate such that a slight meniscus of adhesive protrudes from each passage 22A by the time a group of filters reaches the passages 22A. Thus a dab of liquid adhesive is applied to each joint and is subsequently rolled around the joint. It is not essential for the adhesive to be spread completely around the joint, but the final film of adhesive should preferably extend around at least about 270° of the circumference of the filter sections.

The following modification in carrying out the present invention may be possible in suitable circumstances. Instead of hot-melt adhesive being spread around the joint between adjacent rod sections, it could be dabbed onto the joint to provide a kind of spot weld. Another possibility is that a group of rods may be "spot welded" in this manner to secure them in position relative to one another, and may be subsequently passed between a heated rolling plate (warm enough to soften the adhesive) by which the adhesive is spread somewhat; the joint may be completed by the addition of further adhesive, for example in one of the ways already described.

Figure 6:
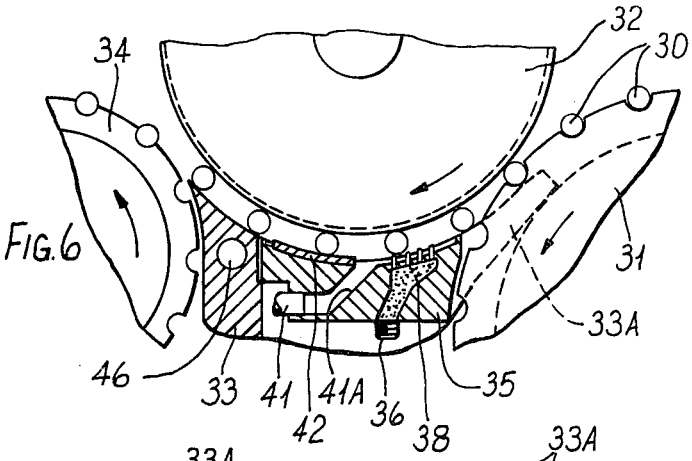
FIG. 6 is a partly sectioned elevation of another apparatus.

FIG. 6 shows an apparatus which is like that shown in FIG. 1 in that groups of filter sections 30 are conveyed sideways by a fluted drum 31 to a rolling station between a rolling drum 32 and a rolling plate 33. Completed assemblies are conveyed away by a fluted drum 34.

Adhesive is applied directly to the groups of filter sections by a number of nozzle units 35. Each nozzle unit applies the adhesive necessary to form one of the joints in the case of a group such as that shown in FIG. 3. Adhesive is delivered to each nozzle unit through a pipe 36 leading to a space 38 below four adhesive outlets 39A to D. Each adhesive outlet comprises an upwardly extending tubular nipple which is surrounded by a relieved area forming a valley 40 from which excess adhesive can flow into a discharge pipe 41 via a downwardly inclined ramp 41A.

It will be noted that the outlets 39A and 39C lie along one line parallel to the sides of the nozzle unit (and parallel to the direction of movement of the assemblies), and that the outlets 39B and 39D lie along a line parallel to but offset from the line containing the outlets 39A and 39C. In use, the abutting faces of the filter sections pass between those two lines so that the outlets 39A and 39C apply dabs of adhesive to one filter section while the outlets 39B and 39D apply dabs of adhesive to the other filter section, no adhesive being applied directly onto the interface between the two filter sections. Downstream of the outlets (in relation to the direction of movement of the filter sections past the nozzle units) each nozzle unit includes a hot ironing plate 41 which spreads the adhesive around the adjacent ends of the filter sections; a valley 43 extends around the ironing plate 42 to convey to the discharge pipe 41 any excess adhesive which spills over from the ironing plate.

Around the valleys 40 and 43 there is a rim 44. The adhesive outlets 39A to D and the ironing plate 42 project slightly outwards from the rim so that they can contact the groups of filter sections during rolling, whereas the rim preferably does not contact the groups or at least contacts them only slightly so as not to score them.

Each nozzle unit is kept hot by the adhesive but may also include a heating element (not shown).

It should furthermore be noted that the distance between the outlets 39A & 39D is somewhat less than the circumference of each group of filters. The arrangement is preferably such that the adhesive is spread almost completely around the groups; it is desirable to avoid the spread film of adhesive overlapping at its ends as this would produce an excessive localised thickness of adhesive at the overlap area.

Each outlet 39A, B, C and D serves virtually as a point source of adhesive. Excess adhesive spills over from the outlets all the way around the outlets and is returned by the pipe 41 to a reservoir from which the adhesive is delivered by a pump to the pipes 36. By this means a closely controlled quantity of adhesive can be applied to the filter sections.

Each of the nozzle units 35 is mounted in a slot within the rolling plate 33 and is preferably spaced from the rolling plate. In other words, there is a clearance gap 45; this is to prevent a direct transfer of heat from the nozzle units to the rolling plate. The main body of the rolling plate downstream of the nozzle units may be cooled by cooling fluid passing through a passage 46 so that contact with the rolling plate cools the adhesive so as to cause it to set at least partially before the finished assemblies are transferred to the drum 34.

As in FIG. 6, finger portions 33A on the rolling plate help to strip the groups 30 from the filter drum 31, for which purpose the drum 31 has circumferential grooves into which the finger portions 33A extend.

The drum 32 may have circumferentially extending recesses in alignment with the nozzle units to avoid contact with the adhesive.

Figure 7:
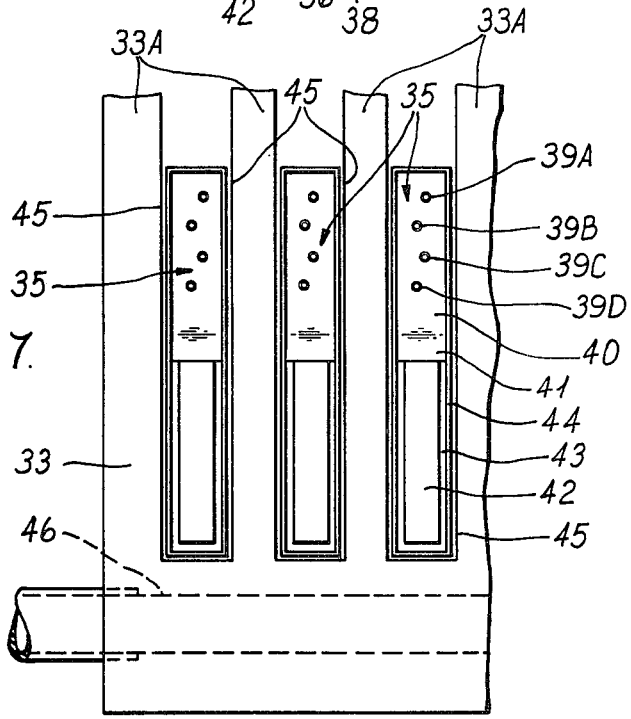
FIG. 7 is a plan view, on an enlarged scale, of the rolling plate and nozzle arrangement of the apparatus shown in FIG. 6.
Figure 8:
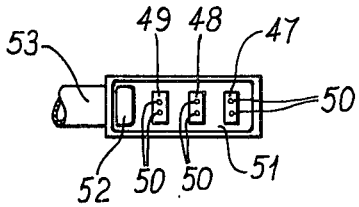
FIG. 8 is a plan view of an alternative nozzle unit.

FIG. 8 shows an alternative form of nozzle unit which may replace each of the nozzle units 35 shown in FIGS. 6 and 7. The nozzle unit includes three upwardly projecting lands 47, 48 and 49 which contact the filter sections while they are being rolled between the rolling drum and the rolling plate, each land having two small-diameter passages 50 through which adhesive is delivered from a space below the lands (not shown). Around the lands 47 and 49 there is a valley 51 into which excessive adhesive spills over from the lands, this excess adhesive being conveyed away via a downwardly extending passage 52 leading to a discharge pipe 53.

As in the example shown in FIGS. 6 and 7, the adhesive outlet passages 50 lie in two lines between which one of the interfaces between abutting filter sections passes. The nozzle unit shown in FIG. 8 does not include an ironing plate, the adhesive in this case being spread around the filter sections by the rolling plate.

In both forms of apparatus shown in FIGS. 6 and 7 and FIG. 8, the continuous flow of adhesive through the outlets of the nozzle and into the surrounding valley helps to ensure that a substantially constant amount of adhesive is applied to each group of filter sections. It is still desirable to maintain as nearly constant as possible the temperature and pressure of the adhesive in the nozzle units, through the overspill of excess adhesive into the valleys reduces the sensitivity of the system to slight temperature and pressure variations.

A suitable hot melt adhesive is a modified form of the adhesive made by Swift Chemical Co. (a division of Swift and Co. Ltd.) and identified as their adhesive K860. The modified form (identified as B 700/30) has a slightly greater "wax" content.

FIGS. 9 and 10 show a modification of the apparatus shown in FIG. 1. As in FIG. 1, groups of filter sections 60 are delivered by a fluted drum 61 to a rolling area between a rolling plate 62 and a heated rolling drum 63. Completed assemblies are received by a fluted drum 64. In this example, however, instead of individual patches of adhesive film being formed in recesses in the drum, a number of continuous films of adhesive 65, axially spaced along the drum 63, are applied to the drum 63 by an applicator 66. Each group of filter sections picks up sections of the films while it is being rolled between the drum 63 and rolling plate 62, and any adhesive which may be left on the drum 63 passes back into the applicator 66.

As in the example shown in FIGS. 1 and 2, the rolling plate 62 has fingers 62A which help to remove the groups of filter sections from the drum 61; and the main part of the rolling plate has recesses providing a clearance so that the rolling plate does not touch the adhesive.

The applicator 66 comprises a body formed with six deep grooves forming chambers 67 which open out in the inner face 68 of the body which is concave so as to match the periphery of the drum 63. Parts 68A to G of the inner surface 68 thus form a running seal with the surface of the drum 63. A manifold 69 extends along the outer face of the body 66 and has an adhesive inlet 70. Adhesive passes from the manifold 69 via apertures 71 leading into the chambers 67.

At the downstream end each chamber 67 is terminated by a wall 72 which is slightly recessed below the surface 68 so as to allow a film of predetermined thickness (e.g. 0.075 mm) to be carried out on the drum 63. At the upstream end of each chamber 67 an end wall 73 is slightly recessed to receive any adhesive which may still remain on the drum, the recess in the wall 73 having converging sides 73A to gather in any adhesive which may have spread slightly along the drum.

As an alternative, the drum 63 could have circumferentially extending recesses extending all the way around the drum to receive the films of adhesive, in which case the end walls 72 and 73 of the grooves 67 need not be recessed.

Adhesive may be delivered to the applicator 66 via a heated pipe and a heated valve (not shown), the valve possibly having means for controlling the flow of adhesive to ensure that the applicator is kept full or nearly full, without excessive pressure being present in the applicator. Alternatively the adhesive may be supplied to the applicator by a constant-volume pump which supplies adhesive at a rate sufficient to keep the applicator nearly but not entirely full of adhesive.

We claim:

1. Apparatus for joining at least two axially abutting rods of the cigarette industry, comprising a rolling drum, means for delivering a rod assembly including at least two abutting rods in axial alignment to the rolling drum, means including a rolling device mounted adjacent to the drum to roll the rod assembly with respect to the drum, said rolling drum and said rolling device being arranged so that the rods are maintained in axial alignment as they are rolled, and means for applying a hot-melt adhesive to the rod assembly to produce a bonding film which overlaps the adjacent ends of the abutting rods and extends at least around a major part of the circumference of the abutting rods.

2. Apparatus according to claim 1 in which the delivery of adhesive is achieved by means of a nozzle which applies to the drum a film of adhesive which is picked up by the rods.

3. Apparatus according to claim 2 in which the rolling device comprises a plate which is arranged to grip the rods in cooperation with the drum and has a recess providing clearance for the adhesive, so that the plate does not contact the adhesive.

4. Apparatus according to claim 2 in which the drum is heated so as to maintain the film of adhesive in a liquid state.

5. Apparatus according to claim 4, including means for cooling the rolling device to promote setting of the bonding film of adhesive.

6. Apparatus according to claim 2, including a plurality of nozzles arranged to apply relatively narrow films of adhesive at axially spaced positions on the surface of said rolling drum.

7. Apparatus according to claim 1 in which the delivery of adhesive to the rods is achieved by a nozzle which applies adhesive directly onto the rods.

8. Apparatus according to claim 7 in which the rolling device is a rolling plate and in which the nozzle is adjacent to or within the rolling plate so as to apply adhesive to the rods while they are being rolled between the rolling plate and the drum.

9. Apparatus according to claim 1 for joining together groups of axially aligned filter rod sections of which each group includes sections of at least two different compositions alternating with one another, including a fluted drum for feeding the groups successively to the rolling drum, and for maintaining and delivering said groups in axial alignment and a fluted drum which receives the groups after they have been joined together by the adhesive to form composite filter rods.

10. Apparatus according to claim 1 wherein said delivering means comprises conveyor means having at least one carrier for moving said rods in a transverse direction while maintaining them in axial alignment.

11. Apparatus according to claim 1, wherein the rolling drum is provided with at least one set of circumferentially-spaced recesses for conveying adhesive to the rods.

12. Apparatus for joining at least three axially abutting rods of the cigarette industry, comprising conveyor means including at least one carrier for conveying at least three rods in abutment and in axial alignment, a rolling drum, a rolling device mounted adjacent to the rolling drum and defining therewith a channel for rolling passage of the rods, said conveyor means being arranged to deliver said rods to said channel, and means for conveying adhesive to the rods along separate parallel transverse paths in alignment with each pair of adjacent ends of said rods to produce separate bonding films which overlap the respective adjacent ends of the rods.

13. Apparatus according to claim 12, wherein said adhesive paths lie on the rolling drum.

14. Apparatus according to claim 12, wherein said adhesive paths are defined by passages in said rolling device.

15. Apparatus for joining at least two axially abutting rods of the cigarette industry, comprising means for delivering at least two abutting rods in axial alignment to a rolling drum, a rolling plate mounted adjacent to the drum to roll the rods with respect to the drum, and means for applying a hot-melt adhesive to the rods to produce a bonding film which overlaps the adjacent ends of the rods and extends at least around a major part of the circumference of the rods, the rolling plate including a recess providing clearance for the adhesive, so that the plate does not contact the adhesive.

* * * * *